US006913791B2

(12) United States Patent
Burca et al.

(10) Patent No.: US 6,913,791 B2
(45) Date of Patent: Jul. 5, 2005

(54) METHOD OF SURFACE TREATING TITANIUM-CONTAINING METALS FOLLOWED BY PLATING IN THE SAME ELECTROLYTE BATH AND PARTS MADE IN ACCORDANCE THEREWITH

(75) Inventors: Florin Burca, Kitchener (CA); John Darmon, Guelph (CA)

(73) Assignee: COM DEV Ltd., Cambridge (CA)

( * ) Notice: Subject to any disclaimer, the term of this patent is extended or adjusted under 35 U.S.C. 154(b) by 183 days.

(21) Appl. No.: 10/376,475

(22) Filed: Mar. 3, 2003

(65) Prior Publication Data

US 2004/0173465 A1 Sep. 9, 2004

(51) Int. Cl.[7] ..... B05D 3/00; B05D 3/04; B05D 3/02; C25D 5/34; C25D 5/50

(52) U.S. Cl. ..... 427/299; 427/309; 427/376.8; 427/405; 427/437; 427/438; 205/219; 205/228

(58) Field of Search ..... 427/212, 219, 427/299, 307, 376.8, 405, 437, 436, 309, 438; 428/615, 670; 205/170, 181, 228, 191, 219

(56) References Cited

U.S. PATENT DOCUMENTS

| | | | | |
|---|---|---|---|---|
| 4,101,386 A | | 7/1978 | Dötzer et al. | |
| 4,221,845 A | | 9/1980 | Koehler | |
| 4,416,739 A | | 11/1983 | Turner | |
| 4,525,250 A | | 6/1985 | Fahrmbacher-Lutz et al. | |
| 4,588,480 A | | 5/1986 | Thoma | |
| 4,655,884 A | | 4/1987 | Hills et al. | |
| 4,902,388 A | | 2/1990 | Fornwalt et al. | |
| 4,904,352 A | | 2/1990 | Witte | |
| 4,938,850 A | * | 7/1990 | Rothschild et al. | 205/191 |
| RE33,800 E | | 1/1992 | Fornwalt et al. | |
| 5,116,430 A | | 5/1992 | Hirai et al. | |
| 5,464,524 A | | 11/1995 | Ogiwara et al. | |
| 6,039,860 A | | 3/2000 | Cooper et al. | |

FOREIGN PATENT DOCUMENTS

| | | | | |
|---|---|---|---|---|
| JP | 63186891 A | * | 8/1988 | C25D/5/38 |
| JP | 08176852 A | * | 7/1996 | C23F/1/26 |

OTHER PUBLICATIONS

Lowenheim, "Electroplating", pp. 218–219 (no month, 1978).*

* cited by examiner

*Primary Examiner*—Edna Wong
(74) *Attorney, Agent, or Firm*—Bereskin & Parr; Isis E. Caulder

(57) ABSTRACT

A method for surface treating a titanium-containing metal, comprising the steps of: (a) treating at least a portion of a surface of the titanium-containing metal with an anodic activation in an electrolyte bath; and (b) strike plating at least a portion of the surface of the treated titanium-containing metal with a metallic coating in the same electrolyte bath as in step (a), wherein the titanium-containing metal remains submerged in the electrolyte bath during steps (a) and (b). The invention also provides for a method for plating a titanium-containing metal, comprising the steps of: (a) surface treating the titanium-containing metal with the method disclosed herein; (b) strike plating at least a portion of the first struck titanium-containing metal with a second metallic coating in a second electrolyte bath; and (c) non-oxidatively heat treating the second struck titanium-containing metal for a period of time sufficient to cause diffusion bonding between the first metallic coating and the titanium-containing metal. The invention also provides parts made in accordance with the methods disclosed herein.

43 Claims, 1 Drawing Sheet

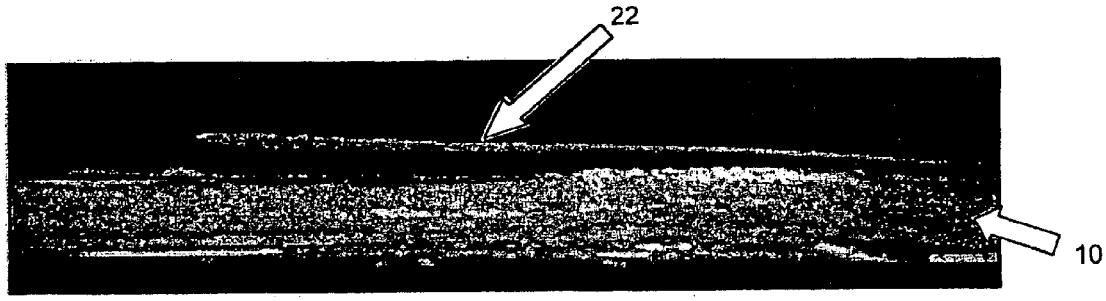
Figure 1 – (Prior Art)
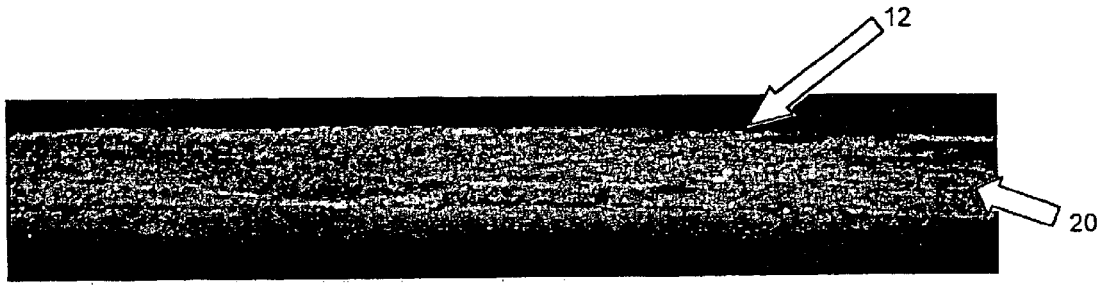
Figure 2

METHOD OF SURFACE TREATING TITANIUM-CONTAINING METALS FOLLOWED BY PLATING IN THE SAME ELECTROLYTE BATH AND PARTS MADE IN ACCORDANCE THEREWITH

FIELD OF THE INVENTION

The present invention relates generally to titanium-containing metals with adherent metal coatings and to methods for producing same.

BACKGROUND OF THE INVENTION

Titanium-containing metals are of great interest to the aerospace industry because they have low densities, low thermal expansion coefficients, and high structural strengths. Parts made from titanium-containing metals are lightweight, and can withstand high thermal stresses and high physical loads.

In some applications, it is desirable to deposit a metallic coating onto the surface of the part. However, the part rapidly oxidizes when exposed to oxygen to create an oxide layer that is electrically and chemically passive in nature. The presence of this passive oxide layer severely inhibits the chemical bonding that takes place between the metallic coating and the part. As a result, it is extremely difficult to deposit an adherent metal coating onto the part. Even when the metallic coating is successfully deposited onto the oxide layer of the part, adhesion tends to be poor. Consequently, the metallic coating is of little value since it can easily be removed from the surface of the part by bending, peeling and/or scratching.

Aggressive pretreatments, such as grit blasting and/or the use of harsh etchants (i.e., hydrofluoric acid or chrome-based chemicals), are commonly used to remove the passive oxide layer from the surface of the part prior to depositing the metallic coating. However, these aggressive pretreatments cannot be used for precision electronic aerospace parts because such parts have tight tolerances and prescribed surface finishes. Moreover, the harsh etchants are harmful to humans and to the environment.

U.S. Pat. No. 5,464,524 discloses a plating method for a nickel-titanium alloy member that comprises the steps of: (a) subjecting the member to an anodic electrolyzing treatment (member becomes the anode) and a cathodic electrolyzing treatment (member becomes the cathode) in an electrolyte bath containing chloride ions for the purpose of removing the oxide layer; (b) rinsing the member; (c) strike plating the member; and (d) electroplating the struck member.

U.S. Pat. No. 4,938,850 discloses a method for plating electroless nickel onto a piece of titanium consisting of the steps of: (a) cleaning the piece of titanium; (b) contacting the piece of titanium to a concentrated hydrochloric solution; (c) activating the piece of titanium in a solution of nitric acid and hydrofluoric acid to remove the oxide layer; (d) treating the surface of the piece of titanium by 'anodic processing' in a treatment solution of acetic acid and hydrofluoric acid to avoid the formation of an oxide film on the titanium; (e) rinsing the piece of titanium; (f) strike plating the piece of titanium; (g) electroless plating the piece of titanium with a nickel layer; and (h) heat treating the piece of titanium.

The '524 patent and the '850 patent both teach removal of the oxide layer from the piece of metal in an electrolyte bath, intermittently rinsing the surface of the metal with water, and subsequently striking the surface of the metal with nickel in a different electrolyte bath. In both methods, the metal is exposed to oxygen as it is physically lifted from the initial bath, rinsed, and placed into the next bath. This exposure to oxygen promotes the growth of an oxide layer on the surface of the metal prior to the step of strike plating the metal with nickel. This tends to result in poor adhesion between the metallic coating and the metal.

There is an ongoing need for a method of surface treating a titanium-containing metal to remove the oxide layer and subsequently plating the treated surface of the metal with an adherent metallic coating before the reformation of the oxide layer.

SUMMARY OF THE INVENTION

In one aspect, the present invention provides a method for surface treating a titanium-containing metal, comprising the steps of:

(a) treating at least a portion of a surface of the titanium-containing metal with an anodic activation in an electrolyte bath; and (b) strike plating at least a portion of the surface of the treated titanium-containing metal with a metallic coating in the same electrolyte bath as in step (a), wherein the titanium-containing metal remains submerged in the electrolyte bath during and between steps (a) and (b).

In another aspect, the present invention provides a method for plating a titanium-containing metal, comprising the steps of:

(a) treating at least a portion of a surface of the titanium-containing metal with an anodic activation and subsequently strike plating at least a portion of the surface of the treated titanium-containing metal with a first metallic coating in a first electrolyte bath, wherein the titanium-containing metal remains submerged in the first electrolyte bath for the duration of step (a);

(b) strike plating the first struck titanium-containing metal with a second metallic coating in a second electrolyte bath; and (c) non-oxidatively heat treating the second struck titanium-containing metal for a period of time sufficient to cause diffusion bonding between the first metallic coating and the titanium-containing metal.

In another aspect, the present invention provides a method for plating a titanium-containing metal, comprising the steps of:

(a) treating at least a portion of a surface of the titanium-containing metal with an anodic activation and subsequently strike plating at least a portion of the surface of the treated titanium-containing metal with a first metallic coating in a first electrolyte bath, wherein the titanium-containing metal remains submerged in the first electrolyte bath for the duration of step (a);

(b) strike plating the first struck titanium-containing metal with a second metallic coating in a second electrolyte bath;

(c) non-oxidatively heat treating the second struck titanium-containing metal for a period of time sufficient to cause diffusion bonding between the first metallic coating and the titanium-containing metal;

(d) electroless plating a third metallic coating onto the surface of the non-oxidatively heat treated titanium-containing metal in a third electrolyte bath; and (e) heat treating the third struck titanium-containing metal at a temperature and for a period of time sufficient to promote adhesion between the third metallic coating and the second metallic coating.

In another aspect, the present invention provides a part comprising a titanium-containing metal having an adherent metallic coating when made by a method in accordance with the present invention, comprising the steps of:

(a) treating at least a portion of a surface of the titanium-containing metal with an anodic activation in an electrolyte bath; and (b) strike plating at least a portion of the surface of the treated titanium-containing metal with a metallic coating in the same electrolyte bath as in step (a), wherein the titanium-containing metal remains submerged in the electrolyte bath during and between steps (a) and (b).

In another aspect, the present invention provides a part comprising a titanium-containing metal having an adherent metallic coating when made by a method in accordance with the present invention, comprising the steps of:

(a) treating at least a portion of a surface of the titanium-containing metal with an anodic activation and subsequently strike plating at least a portion of the surface of the treated titanium-containing metal with a first metallic coating in a first electrolyte bath, wherein the titanium-containing metal remains submerged in the first electrolyte bath for the duration of step (a);

(b) strike plating at least a portion of the first struck titanium-containing metal with a second metallic coating in a second electrolyte bath; and (c) non-oxidatively heat treating the second struck titanium-containing metal for a period of time sufficient to cause diffusion bonding between the first metallic coating and the titanium-containing metal.

In another aspect, the present invention provides a part comprising a titanium-containing metal having an adherent metallic coating when made by a method in accordance with the present invention, comprising the steps of:

(a) treating at least a portion of a surface of the titanium-containing metal with an anodic activation and subsequently strike plating at least a portion of the surface of the treated titanium-containing metal with a first metallic coating in a first electrolyte bath, wherein the titanium-containing metal remains submerged in the first electrolyte bath for the duration of step (a);

(b) strike plating the first struck titanium-containing metal with a second metallic coating in a second electrolyte bath;

(c) non-oxidatively heat treating the second struck titanium-containing metal for a period of time sufficient to cause diffusion bonding between the first metallic coating and the titanium-containing metal;

(d) electroless plating a third metallic coating onto the surface of the non-oxidatively heat treated titanium-containing metal in a third electrolyte bath; and (e) heat treating the third struck titanium-containing metal at a temperature and for a period of time sufficient to promote adhesion between the third metallic coating and the second metallic coating.

BRIEF DESCRIPTION OF THE DRAWINGS

For a better understanding of the present invention, and to show more clearly how it may be carried into effect, reference will now be made, by way of example, to the accompanying drawings, which show exemplary embodiments of the present invention and in which:

FIG. 1 is a cross-sectional view of a titanium-containing metal coupon plated by a prior art method taken along the fracture line formed by a bend test;

FIG. 2 is a cross-sectional view of a titanium-containing metal coupon plated by with the methods disclosed herein taken along the fracture line formed by a bend test; and

DETAILED DESCRIPTION OF THE INVENTION

The methods in accordance with the present invention can be applied to any type of titanium-containing metal well known in the art. Examples of titanium-containing metals include, but are not limited to, (a) commercially pure titanium; (b) an alloy of 5 weight percent aluminum, 2.5 weight percent tin, and 92.5 weight percent titanium; and (c) an alloy of 6 weight percent aluminum, 4 weight percent vanadium, and 90 weight percent titanium (Ti-6AI-4V).

The methods in accordance with the present invention can be applied to titanium-containing metal parts with relatively flat geometries (i.e., parts with a limited number of curved surfaces, recessed areas, and/or internal surfaces). Examples of these types of parts include, but are not limited to, screws, pedestals, and resonators. In its preferred form, the present invention can be applied to treat titanium-containing metal parts with intricate geometries (i.e., parts with curved surfaces, recessed areas, and/or internal surfaces). An example of this type of part includes, but is not limited to, waveguide manifolds for multiplexer assemblies.

Multiplexer assemblies that are used in aerospace applications are designed to have insignificant dimensional changes as a result of changes in temperature so that the spacing between filters does not appreciably change with changes in temperature. As a result, it is desirable to use temperature stable aerospace waveguide assemblies comprised of metals that have low expansion co-efficients. The methods in accordance with the present invention can be used to provide a waveguide assembly comprised of a titanium-containing metal, such as Ti-6 AL-4 V, having an adherent silver coating.

The surface of the titanium-containing metal can be cleaned to remove grease, dirt, and other physical contaminants. The cleaning step(s) are not limited to any specific method(s), and may include any method well known in the art.

The cleaning step(s) can include, for example, an ultrasonic alkaline cleaning step followed by an anodic electroclean step in an alkaline solution. Ultrasonic agitation of the titanium-containing metal in the cleaner increases the efficiency of the removal of grease, dirt and other physical contaminants from the surface of the titanium-containing metal. The anodic electroclean step is a type of micro-scale cleaning. In this example, the titanium-containing metal is treated in an ultrasonic alkaline cleaner comprising an aqueous ethoxylated alcohol solution (e.g., 3% v/v Cleanaire 1200™ which is commercially available from Rochester Midland) at a temperature of about 25° C. to about 90° C., more preferably about 50° C. to about 70° C., and most preferably about 60° C. for about 1 minute to about 60 minutes, more preferably about 10 minutes to about 20 minutes, and most preferably about 15 minutes. Next, the titanium-containing metal is treated with an anodic electroclean in an alkaline solution comprising sodium hydroxide, silicic acid, and carbonic acid (e.g., 62.5 g/L Electromet™ which is commercially available from Atotech) at a temperature of about 50° C. to about 95° C., more preferably about 50° C. to about 70° C., and most preferably about 60°

C. and a voltage is applied to impart an electric current that results in a current density of about 20 amperes per square foot to about 80 amperes per square foot, more preferably about 45 amperes per square foot to about 55 amperes per square foot, and most preferably about 50 amperes per square foot for about 15 seconds to about 600 seconds, more preferably about 30 seconds to about 90 seconds, and most preferably about 60 seconds. After each cleaning step, the titanium-containing metal is rinsed with an appropriate rinsing agent, for example, deionized water, to remove any residual solution.

Next, the surface of the titanium-containing metal can be chemically cleaned and activated in a solution. Ultrasonic agitation of the titanium-containing metal in the solution helps to increase the efficiency of the treatment in removing oxides from the surface of the titanium-containing metal. This activation step enhances adhesion between the surface of the titanium-containing metal and the first metallic coating that is subsequently applied. After the activation step, the titanium-containing metal is rinsed with an appropriate rinsing agent, for example, deionized water, to remove any residual solution.

In one aspect of the invention, the solution comprises about 5 mol/L hydrochloric acid to about 15 mol/L, more preferably the solution comprises about 8 mol/L hydrochloric acid to about 12 mol/L hydrochloric acid, and most preferably the solution comprises about 10.2 mol/L hydrochloric acid. Preferably, the titanium-containing metal is immersed in the solution for about for about 2 minutes to about 15 minutes, more preferably about 5 minutes to about 10 minutes, and most preferably about 6 minutes.

In a particularly preferred aspect of the invention, the solution comprises about 7.1 mol/L to about 9.7 mol/L hydrochloric acid and about 0.5 mol/L to about 3.1 mol/L fluoboric acid, more preferably the solution comprises about 7.6 mol/L to about 8.7 mol/L hydrochloric acid and about 1.6 mol/L to about 2.6 mol/L fluoboric acid, and most preferably the solution comprises about 8.1 mol/L hydrochloric acid and about 2.1 mol/L fluoboric acid. Preferably, the titanium-containing metal is immersed in the solution for about 1 minute to about 15 minutes, more preferably about 2 minutes to about 5 minutes, and most preferably about 3 minutes. The fluoboric acid acts as a buffer or pH stabilizer in the solution to temper the strength of the hydrochloric acid. This has been shown to enhance the efficacy of this step.

Next, at least a portion of the surface of the titanium-containing metal, more preferably a substantial portion of the surface, and most preferably essentially all of the surface is treated with an anodic activation in a first electrolyte bath, and subsequently at least a portion of the treated surface, more preferably a substantial portion of the treated surface, and most preferably essentially all of the treated surface is strike plated with a first metallic coating in the same first electrolyte bath. The titanium-containing metal remains submerged in the first electrolyte bath during the anodic activation and the subsequent strike plating and also between these steps. Without being bound by theory, it is believed that the anodic activation removes the oxide layer, and the first metallic coating is applied before the reformation of the oxide layer in the same first electrolyte bath.

The first electrolyte bath is formulated to provide a very thin 'seed layer' during the strike plating step. This is partly due to the fact that the first electrolyte bath contains portions of the oxide layer that was originally removed from the surface of the titanium-containing metal during the anodic activation. Therefore, if the titanium-containing metal is kept in the bath too long it may tarnish. Accordingly, in a particularly preferred embodiment the strike plating step is adapted to provide a very thin seed layer for the purpose of covering essentially all of the surface of the titanium-containing metal before the reformation of the oxide layer.

This surface treatment is achieved by providing an electrochemical cell comprising the first electrolyte bath, an anode comprising the titanium-containing metal, and a cathode. A preferred first electrolyte bath comprises nickel chloride and hydrochloric acid and is commonly referred to as a Woods nickel bath. A preferred cathode comprises nickel. The first electrolyte bath can contain, for example, about 50 g/L to about 70 g/L nickel chloride and about 100 ml/L to about 144 ml/L hydrochloric acid. In this context, the first metallic coating comprises nickel.

It is appreciated that the first electrolyte bath can be chosen from any type of acidic electrolyte bath well known in the art. Examples of suitable first electrolyte baths, include, but are not limited to: (a) a Watts nickel bath comprising nickel sulfate, nickel chloride, and boric acid; and (b) an acid copper bath comprising copper sulfate, sulfuric acid, and hydrochloric acid.

In one aspect, a voltage is applied to the surface of the titanium containing metal after immersion of the titanium-containing metal in the first electrolyte bath. In a preferred embodiment, the voltage is applied to the surface of the titanium-containing metal prior to immersion of the titanium-containing metal in the first electrolyte bath. Upon immersion of the titanium-containing metal, the electrical circuit is completed and a suitable electric current is applied to the surface of the titanium-containing metal for a period of time sufficient to treat at least a portion, more preferably a substantial portion, and most preferably essentially all of the surface of the titanium-containing metal. Preferably, the electric current results in a current density of about 30 amperes per square foot to about 70 amperes per square foot, more preferably about 40 amperes per square foot to about 55 amperes per square foot, and most preferably about 50 amperes per square foot. The current density is substantially uniform across the surface of the titanium-containing metal. Preferably, the voltage is applied for about 15 seconds to about 120 seconds, more preferably about 30 seconds to about 60 seconds, and most preferably about 45 seconds. The degree of treatment of the surface of the titanium-containing metal is controlled by the magnitude of the current and the length of time the current is imparted to the surface of the titanium-containing metal. It is understood that the longer periods of time compensate for the decrease in bath efficiency occurring when lower electrical currents are utilized. Likewise, shorter time periods may be used when higher electrical currents are applied. As mentioned above, it is believed that this treatment removes the oxide layer from the surface of the titanium-containing metal.

Next, while keeping the titanium-containing metal submerged in the first electrolyte bath (to prevent the instantaneous reformation of the oxide layer), the polarities of the electrochemical cell are set such that the titanium-containing metal becomes cathodic. A voltage is applied to the treated surface of the titanium-containing metal to impart a suitable electric current for a period of time sufficient to plate at least a portion, more preferably a substantial portion, and most preferably essentially all of the treated surface of the titanium-containing metal with a first metallic coating. Preferably, the electric current results in a current density of about 30 amperes per square foot to about 70 amperes per square foot, more preferably about 40 amperes per square foot to about 55 amperes per square foot, and most preferably about 50 amperes per square foot. During the strike plating step, the current density is substantially uniform across the surface of the titanium-containing metal. Preferably, the voltage is applied for about 2 minutes to about 15 minutes, more preferably about 4 minutes to about 6 minutes, and most preferably about 5 minutes. The thickness of the first metallic coating is controlled by the magnitude of the current and the length of time the current is imparted to the surface of the titanium-containing metal. It is understood that the longer periods of time compensate for the decrease in bath efficiency occurring when lower electrical currents are utilized. Likewise, shorter time periods may be used when higher electrical currents are applied. As mentioned above, this strike plating step is adapted to provide a seed layer on the surface of the titanium-containing metal before the reformation of the oxide layer.

The surface-treatment described above effectively removes the passive oxide layer and subsequently strike plates the treated surface with the first metallic coating before the reformation of the oxide layer. Preferably, the first metallic coating has a thickness of about 150 nm to about 500 nm, more preferably about 250 nm to about 400 nm, and most preferably about 330 nm.

Next, the surface is rinsed with a suitable rinsing agent, for example, deionized water, to remove any residual plating bath material. The first struck titanium-containing metal is strike plated with a second metallic coating in a second electrolyte bath. As mentioned above, the first strike plating in the first electrolyte bath is only adapted to provide a thin seed layer. It is preferable to add a second metallic coating before subsequently heating the titanium-containing metal in a non-oxidative heat treating step which will be described in more detail below. Without being bound by theory, it is believed that the presence of the second metallic coating enhances adhesion between the first metallic coating and the titanium-containing metal during the non-oxidative heat-treating step.

This strike plating is achieved by providing an electrochemical cell comprising the second electrolyte bath, an anode and a cathode comprising the titanium-containing metal. A preferred second electrolyte bath comprises nickel sulfamate, nickel chloride and boric acid and is commonly referred to as a Sulfamate bath. A preferred anode comprises nickel. The second electrolyte bath can contain, for example, about 300 g/L to about 375 g/L nickel sulfamate, about 7 g/L to about 23 g/L nickel chloride, and about 30 g/L to about 45 g/L boric acid. In this context, the second metallic coating comprises nickel. Preferably, the pH of the second electrolyte bath is about 3 to about 5, more preferably about 3.5 to about 4.5, and most preferably about 4. Alternatively, the second electrolyte bath can be a Watts nickel bath comprising nickel sulfate, nickel chloride, and boric acid.

The strike plating is performed by applying a voltage to impart an electric current for a period of time sufficient to deposit the second metallic coating to a desired thickness. The thickness of the second metallic coating is not critical, but can range for example between about 1.5 $\mu$m to about 2.5 $\mu$m. Preferably, the electric current results in a current density of about 10 amperes per square foot to about 50 amperes per square foot, more preferably about 15 amperes per square foot to about 25 amperes per square foot, and most preferably about 20 amperes per square foot. Preferably, the voltage is applied for about 5 minutes to about 30 minutes, more preferably about 7 minutes to about 15 minutes, and most preferably about 10 minutes. The titanium-containing metal may be rotated in the second electrolyte bath to ensure a uniform deposition of the second metallic coating on the entire surface of the metal. The bath may also be stirred or agitated during the plating step to stimulate the movement of the metal ions so as to replenish the supply of metal ions near the surface of the metal being plated. Preferably, the second electrolyte bath is heated to a temperature of about 40° C. to about 60° C., more preferably about 45° C. to about 55° C., and most preferably about 49° C. An increase in bath temperature also serves to stimulate the movement of the metal ions in the bath.

After the second metallic coating has been applied on the first metallic coating, the titanium-containing metal may be rinsed with a suitable rinsing agent, for example, deionized water, to remove any residual electroplating bath.

Next, the second struck titanium-containing metal is non-oxidatively heat-treated at a temperature and for a period of time sufficient to cause diffusion bonding between the first metallic coating and the titanium-containing metal. Preferably, the second struck titanium-containing metal is non-oxidatively heat-treated at a temperature of about 300° C. to about 700° C., more preferably about 475° C. to about 500° C., and most preferably about 500° C. for about 1 hours to about 16 hours, more preferably about 3 hours to about 8 hours, and most preferably 5 hours.

In the non-oxidative heat-treating step, a titanium alloy layer is formed between the first metallic coating and the titanium-containing metal without oxidizing the first and second metallic coatings. This titanium alloy layer results in a close and firm adherence of the first metallic coating to the titanium-containing metal.

In one aspect of the invention, the non-oxidative heat-treating step is carried out under a vacuum pressure of about $10^{3}$15 millitor. In another aspect of the invention, the non-oxidative heat-treating step is carried out in an inert or reductive gas atmosphere comprising at least one member selected from the group consisting of nitrogen, argon and hydrogen.

Next, a surface activation treatment may be employed. This surface activating step is not limited to any specific method, and may be any method well known in the art which activates the second metallic coating.

The surface activating step can be effected, for example, where the surface of the non-oxidatively heat treated titanium-containing metal is brought into contact with a surface activating solution comprising sodium fluoride (e.g., 46 g/L Tas 3z™ which is commercially available from Technic). Preferably, the titanium-containing metal is kept in the solution for about 1 minute to about 10 minutes, more preferably 3 minutes to about 6 minutes, and most preferably about 5 minutes.

Next, the surface activated titanium-containing metal is electroless plated with a third metallic coating in a third electrolyte bath. This purpose of this electroless plating step is to provide a uniform layer of metal with a constant thickness. When complex parts having many internal surfaces are electroplated in a conventional electrolytic electroplating bath, the part tends to be unevenly plated (i.e., there tends to be a thicker layer on corners and edges and a thinner layer on the flat portions and recessed areas). Thus, the electroless plating step provides an even layer of metal with a constant thickness. When the parts are used in electronic aerospace applications such as in a multiplexer assembly, it is important to have a metallic coating with a uniform thickness to ensure that the high frequency electromagnetic signals are properly propagated through the part.

This electroless plating is achieved by submersing the piece of titanium-containing metal into the third electrolyte bath. A preferred third electrolyte bath comprises nickel phosphorus (e.g., 6 g/L of nickel via En 3500™ which is commercially available from Technic). In this context, the third metallic coating comprises nickel. Preferably, the pH of the second electrolyte bath is about 4 to about 5, more preferably about 4.5 to about 4.9, and most preferably about 4.6.

The electroless plating step is performed by submersing the activated titanium-containing metal in the third electrolyte bath under conditions and for period of time sufficient to deposit the third nickel coating to a desired thickness. The thickness of the third metallic coating is not critical, but can range for example between about 1.5 $\mu$m to about 7.5 $\mu$m. Preferably, the surface activated titanium-containing metal remains in the electrolyte bath for about 10 minutes to about 60 minutes, more preferably about 20 minutes to about 40 minutes, and most preferably about 30 minutes. Preferably, the second electrolyte bath is heated to a temperature of about 75° C. to about 95° C., more preferably about 80° C. to about 90° C., and most preferably about 85° C. This electroless plating step ensures that the third metallic coating is evenly applied to the surface of the titanium-containing metal.

Next, the third struck titanium-containing metal may be heated at a temperature and for a period of time sufficient to promote adhesion between the third metallic coating and the second metallic coating. Moreover, this heating step increases the hardness of the third metallic coating and the second metallic coating. This enhances adhesion of a subsequently applied metallic coating. Additionally, this heating step forces hydrogen out of the third metallic coating, which in effect reduces hydrogen embrittlement which might otherwise occur if the coating is left untreated.

Preferably, the third struck titanidm-containing metal is heat treated at a temperature of about 100° C. to about 500° C., more preferably about 120° C. to about 200° C., and most preferably about 125° C. for about 1 hours to about 4 hours, more preferably about 1.5 hour to about 3 hours, and most preferably 2 hours.

In some instances, it may be desirable to electroplate one or more additional metallic coatings onto the surface of the titanium-containing metal. The metallic coatings may be chosen from a wide variety of metals, including, but not limited to: copper, silver, gold or rhodium. The composition of the electrolyte bath(s), the current densities applied, and the length of time the current is imparted to the surface of the titanium-containing metal will all depend on the metallic coatings chosen and the desired thicknesses. The metallic coatings may be applied by any plating method that is well known to a person skilled in the art.

By way of example only, a fourth metallic coating can be applied by providing an electrochemical cell comprising a fourth electrolyte bath, an anode and a cathode comprising the titanium-containing metal. A preferred fourth electrolyte bath comprises copper sulfate, sulfuric acid, and hydrochloric acid and is commonly referred to as an acid copper bath. A preferred anode comprises copper. In this context, the fourth metallic coating comprises copper. The fourth metallic coating can be applied under bath concentrations and operating conditions that are well known to a person skilled in the art.

The electroplating is performed by applying a voltage to impart an electric current for a period of time sufficient to deposit the fourth metallic coating to a desired thickness. The thickness of the fourth metallic coating is not critical. Preferably, the electric current results in a current density of about 3 amperes per square foot to about 10 amperes per square foot, more preferably about 4 amperes per square foot to about 6 amperes per square foot, and most preferably about 5 amperes per square foot. Preferably, the voltage is applied for about 15 minutes to about 60 minutes, more preferably about 25 minutes to about 60 minutes, and most preferably about 30 minutes. The titanium-containing metal may be rotated in the fourth electrolyte bath to insure a uniform deposition of the fourth metallic coating on the entire surface of the metal. The bath may also be stirred or agitated during the plating step to stimulate the movement of the metal ions so as to replenish the supply of metal ions near the surface of the metal being plated. Preferably, the fourth electrolyte bath is heated to a temperature of about 40° C. to about 60° C., more preferably about 45° C. to about 55° C., and most preferably about 48° C. An increase in bath temperature also serves to stimulate the movement of the metal ions in the bath.

By way of example only, a fifth metallic coating can be applied by providing an electrochemical cell comprising the fifth electrolyte bath, an anode and a cathode comprising the titanium-containing metal. A preferred fifth electrolyte bath comprises silver and is commonly referred to as an alkaline (cyanide) silver bath. A preferred anode comprises silver. In this context, the fifth metallic coating comprises silver. The fifth metallic coating can be applied under bath concentrations and operating conditions that are well known to a person skilled in the art.

The electroplating is performed by applying a voltage to impart an electric current for a period of time sufficient to deposit the fifth metallic coating to a desired thickness. The thickness of the fifth metallic coating is not critical. Preferably, the electric current results in a current density of about 2 amperes per square foot to about 15 amperes per square foot, more preferably about 3 amperes per square foot to about 10 amperes per square foot, and most preferably about 4.25 amperes per square foot. Preferably, the voltage is applied for about 15 minutes to about 60 minutes, more preferably about 25 minutes to about 60 minutes, and most preferably about 30 minutes. The titanium-containing metal may be rotated in the fifth electrolyte bath to ensure a uniform deposition of the fifth metallic coating on the entire surface of the metal. The bath may also be stirred or agitated during the plating step to stimulate the movement of the metal ions so as to replenish the supply of metal ions near the surface of the metal being plated. Preferably, the fifth electrolyte bath is heated to a temperature of about 20° C. to about 40° C., more preferably about 25° C. to about 35° C., and most preferably about 30° C. An increase in bath temperature also serves to stimulate the movement of the metal ions in the bath.

The following non-limiting example is illustrative of the present invention:

EXAMPLE 1

A titanium-containing metal consisting of 6AL-4V-Ti alloy and sized and shaped to be a waveguide manifold for a multiplexer assembly (i.e., having an intricate geometry including internal surfaces, recessed areas, and corners) was surface treated and plated by the following steps:

(1) Cleaning Steps (i) ultrasonic alkaline cleaning step with an aqueous ethoxylated alcohol solution (e.g., 3% v/v Cleanaire 1200™ which is commercially available from Rochester Midland) for 15 minutes at a temperature of about 60° C.;

(ii) single rinse with deionized water at room temperature;

(iii) anodic electroclean in an alkaline solution comprising sodium hydroxide, silicic acid, and carbonic acid (e.g., 62.5 g/L Electromet™ which is commercially available from Atotech) at a temperature of about 82° C. with a current density of about 50 amperes per square foot for about 1 minute; and (iv) double rinse with deionized water at room temperature.

(2) Surface Activation Step (i) pickling in an aqueous solution containing 8.1 mol/L hydrochloric acid and 2.1 mol/L fluoboric acid at room temperature for 3 minutes; and (ii) single rinse with deionized water at room temperature.

(3) Surface Treatment Step to Remove the Oxide Layer and Provide a Nickel First Coating The surface treatment step was carried out by an electrochemical cell including a Woods electrolyte bath, an anode comprising the titanium-containing metal, and a cathode comprising nickel. The surface treatment included an anodic activation followed by the strike plating method to provide a first nickel coating under the following conditions listed below. The titanium-containing metal remained submerged in the Woods electrolyte bath during the anodic activation and the subsequent strike plating and also between these steps. The Woods electrolyte bath was comprised of between about 50 g/L to about 70 g/L nickel chloride and between about 100 ml/L to about 144 ml/L hydrochloric acid, and the treatment was carried out at room temperature.

(i) anodic activation was carried out at a current density of 50 amperes per square foot for about 45 seconds;

(ii) strike plating with nickel was carried out at a current density of 50 amperes per square foot for about 5 minutes to deposit the first nickel coating.

(4) Strike Plating to Provide a Second Nickel Coating

The strike plating step was carried out by an electroplating method in a Sulfamate bath under the following conditions listed below. The Sulfamate electrolyte bath was comprised of between about 300 g/L to about 375 g/L nickel sulfamate, about 7 g/L to about 23 g/L nickel chloride, and about 30 g/L to about 45 g/L boric acid, and the treatment was carried out at 49° C.

(i) strike plating with nickel was carried out at a current density of 20 amperes per square foot for about 10 minutes to deposit a second nickel coating;

(ii) double rinse with deionized water at room temperature.

(5) Non-Oxidative Heat Treating Step

The titanium-containing metal was heated at a temperature of 500° C. for 5 hours under a vacuum pressure of 10−5 millitor.

(6) Surface Activation Step (i) double rinse with deionized water at room temperature;

(ii) pickling in an aqueous solution containing sodium fluoride (e.g., 46 g/L Tas 3z™ which is commercially available from Technic) at room temperature for 5 minutes; and (ii) double rinse with deionized water at room temperature.

(7) Electroless Plating to Provide a Nickel Third Coating

The plating step was performed by an electroless plating method in a high phosphorus nickel bath under the following conditions listed below. The high phosphorus nickel bath was comprised of nickel phosphorous (e.g., 6 g/L of nickel via En 3500™ which is commercially available from Technic), and the treatment was carried out at 87° C.

(i) submersing the titanium-containing metal in the nickel bath for 30 minutes;

(ii) double rinse in deionized water at room temperature.

(8) Adhesion Bake

The titanium-containing metal was heated at a temperature of 125° C. for 2 hours.

(9) Cleaning Steps (i) single rinse with deionized water at room temperature;

(ii) anodic electroclean in an alkaline solution comprising sodium hydroxide, silicic acid, and carbonic acid (e.g., 62.5 g/L Electromet™ which is commercially available from Atotech) at a temperature of about 82° C. with a current density of about 20 amperes per square foot for about 1 minute;

(iii) double rinse with deionized water at room temperature;

(iv) desmut in a conventional solution for 2 minutes at room temperature to remove organic contaminants;

(v) pickling in an aqueous solution containing sodium fluoride (e.g., g/L Tas 3z™ which is commercially available from Technic) at room temperature for 2 minutes;

(vi) drag-out (which is a type of rinsing);

(vii) double rinse with deionized water at room temperature;

(10) Strike Plating Step to Provide a Copper Fourth Coating

The strike plating step was carried out by an electroplating method in a copper cyanide bath under the following conditions listed below.

(i) strike plating with copper was carried out at a current density of 20 amperes per square foot for about 2 minutes to deposit a copper fourth coating.

(11) Electroplating Step to Provide a Copper Fifth Coating

The electroplating step was carried out by an electroplating method in a copper cyanide bath under the following conditions listed below.

(i) electroplating with copper was carried out at a current density of 5 amperes per square foot for about 30 minutes to deposit a fifth copper coating;

(ii) drag-out; and (iii) triple rinse with deionized water at room temperature.

(13) Strike Plating Step to Provide a Silver Sixth Coating

The strike plating step was carried out by an electroplating method in a silver cyanide bath under the following conditions listed below.

(i) strike plating with silver was carried out at a current density of 9 amperes per square foot for about 20 seconds to deposit a silver sixth coating.

(14) Electroplating Step to Provide a Silver Seventh Coating

The strike plating step was carried out by an electroplating method in a silver cyanide bath under the following conditions listed below.

(i) electroplating with silver was carried out at a current density of 4.25 amperes per square foot for about 30 minutes to deposit a silver seventh coating;

(ii) double rinse with deionized water at room temperature;

(iii) a single heated rinse with deionized water at a temperature of about 68° C.; and (iv) the titanium-containing metal is allowed to air dry.

(15) Adhesion Bake

The titanium-containing metal was heated at a temperature of 125° C. for 2 hours.

EXAMPLE 2

Bend tests were performed on a plated titanium-containing coupon prepared by the method outlined in Example 1, and compared to bend tests performed on a plated titanium-containing coupon that was prepared by a prior art plating method that is outlined in detail below.

The prior art method includes the following steps: (a) a titanium activation step achieved through a series of chromic acid pickling baths; (b) further pickling steps; (c) an electrolytic nickel strike; and (d) plating in an electroless nickel bath.

The bend tests were performed in accordance with standard procedures that are set out in ASTM B571-97e1 entitled "Standard Practice for Qualitative Adhesion Testing of Metallic Coatings. After the coupon was fractured, the coupon was removed from the vice and was visually inspected to determine whether there was peeling of the metallic coating at the edges of the fracture. Next, a sharp edged instrument was used to pick at the surface of the fractured edge to determine if further delamination of the metallic coating could be achieved.

The applicants devised a subjective scale to quantify the extent of delamination of the metallic coating(s) from the surface of the coupon. The scale ranged from 0 (no peeling), 1 (slight evidence of peeling), 2 (strong evidence of peeling), and 3 (fracture alone caused complete delamination of the metallic coating). The results of the bend tests are described in detail below.

FIG. 1 is a cross-sectional view of a titanium-containing metal coupon plated by a prior art method taken along the fracture line formed by the bend test. The titanium-containing metal coupon is shown generally at 10, and the nickel coating is shown generally at 12. The applicants rated this bend test a '3'. The Nickel coating 12 was completely delaminated from the surface of the titanium-containing metal coupon 10 as a result of the bend test alone.

In contrast, FIG. 2 is a cross-sectional view of a titanium-containing metal coupon plated by the method of Example 1 taken along the fracture line formed by the bend test. The titanium coupon additionally underwent thermal cycling to simulate conditions in space applications. The titanium-containing metal coupon is shown generally at 20, and the multiple metallic coatings are shown generally at 22. The applicants rated this bend test a '0' (no peeling). The multiple metallic coatings 22 remained fully adhered to the titanium-containing metal coupon 20 after the bend test, the thermal cycling, and picking with a sharp instrument.

While the above description constitutes the preferred embodiments, it will be appreciated that the present invention is susceptible to modification and change without departing from the fair meaning of the proper scope of the accompanying claims.

What is claimed is:

1. A method for surface treating a titanium-containing metal, comprising the steps of:

(a) treating at least a portion of a surface of the titanium-containing metal with an anodic activation in an electrolyte bath; and (b) strike plating at least a portion of the surface of the treated titanium-containing metal with a metallic coating in the same electrolyte bath as in step (a), wherein the titanium-containing metal remains submerged in the electrolyte bath during and between steps (a) and (b).

2. A method according to claim 1, further comprising the step of cleaning the surface of the titanium-containing metal prior to step (a).

3. A method according to claim 2, further comprising the step of activating the surface of the titanium-containing metal in a solution prior to step (a).

4. A method according to claim 3, wherein the solution comprises hydrochloric acid.

5. A method according to claim 4, wherein the solution further comprises fluoboric acid.

6. A method according to claim 1, wherein the anodic activation in step (a) is performed by applying a voltage to impart an electric current for a period of time sufficient to treat at least a portion of the surface of the titanium-containing metal.

7. A method according to claim 6, wherein the electric current results in a current density of between about 30 amperes per square foot to about 70 amperes per square foot at the surface of the titanium-containing metal and wherein the period of time is from about 15 seconds to about 120 seconds.

8. A method according to claim 7, wherein the electric current results in a current density of about 50 amperes per square foot at the surface of the titanium-containing metal and wherein the period of time is about 45 seconds.

9. A method according to claim 1, wherein the strike plating in step (b) is performed by applying a voltage to impart an electric current for a period of time sufficient to cover essentially all of the surface of the treated titanium-containing metal with the metallic coating.

10. A method according to claim 9, wherein the electric current results in a current density of between about 30 amperes per square foot to about 70 amperes per square foot at the surface of the titanium-containing metal and wherein the period of time is from about 2 minutes to about 15 minutes.

11. A method according to claim 10, wherein the electric current results in a current density of about 50 amperes per square foot at the surface of the titanium-containing metal and wherein the period of time is about 5 minutes.

12. A method according to claim 1, wherein the electrolyte bath comprises nickel chloride and hydrochloric acid.

13. A method according to claim 1, wherein the metallic coating comprises nickel.

14. A method for plating a titanium-containing metal, comprising the steps of:

(a) treating at least a portion of a surface of the titanium-containing metal with an anodic activation and subsequently strike plating at least a portion of the surface of the treated titanium-containing metal with a first metallic coating in a first electrolyte bath, wherein the titanium-containing metal remains submerged in the first electrolyte bath for the duration of step (a);

(b) strike plating the first struck titanium-containing metal with a second metallic coating in a second electrolyte bath; and (c) non-oxidatively heat treating the second struck titanium-containing metal for a period of time sufficient to cause diffusion bonding between the first metallic coating and the titanium-containing metal.

15. A method according to claim 14, further comprising the step of cleaning the surface of the titanium-containing metal prior to step (a).

16. A method according to claim 15, further comprising the step of activating the surface of the titanium-containing metal in a solution prior to step (a).

17. A method according to claim 16, wherein the solution comprises hydrochloric acid.

18. A method according to claim 17, wherein the solution further comprises fluoboric acid.

19. A method according to claim 14, wherein the anodic activation in step (a) is performed by applying a voltage to impart an electric current for a period of time sufficient to treat at least a portion of the surface of the titanium-containing metal.

20. A method according to claim 19, wherein the electric current results in a current density of between about 30 amperes per square foot to about 70 amperes per square foot at the surface of the titanium-containing metal and wherein the period of time is from about 15 seconds to about 120 seconds.

21. A method according to claim 20, wherein the electric current results in a current density of about 50 amperes per square foot at the surface of the titanium-containing metal and wherein the period of time is about 45 seconds.

22. A method according to claim 14, wherein the strike plating in step (a) is performed by applying a voltage to impart an electric current for a period of time sufficient to cover essentially all of the surface of the treated titanium-containing metal with the first metallic coating.

23. A method according to claim 22, wherein the electric current results in a current density of between about 30 amperes per square foot to about 70 amperes per square foot at the surface of the titanium-containing metal and wherein the period of time is from about 2 minutes to about 15 minutes.

24. A method according to claim 23, wherein the electric current results in a current density of about 50 amperes per square foot at the surface of the titanium-containing metal and wherein the period of time is about 5 minutes.

25. A method according to claim 14, wherein the first electrolyte bath comprises nickel chloride and hydrochloric acid.

26. A method according to claim 14, wherein the first metallic coating comprises nickel.

27. A method according to claim 14, wherein the strike plating in step (b) is performed by applying a voltage to impart an electric current for a period of time sufficient to deposit the second metallic coating to a desired thickness.

28. A method according to claim 27, wherein the electric current results in a current density of about 10 amperes per square foot to about 50 amperes per square foot at the surface of the titanium-containing metal, and the period of time is about 5 minutes to about 30 minutes.

29. A method according to claim 28, wherein the electric current results in a current density of about 20 amperes per square foot at the surface of the titanium-containing metal, and the period of time is about 10 minutes.

30. A method according to claim 14, wherein the second electrolyte bath comprises nickel sulfamate, nickel chloride, and boric acid.

31. A method according to claim 14, wherein the second metallic coating comprises nickel.

32. A method according to claim 14, wherein the second struck titanium-containing metal is non-oxidatively heat treated in step (c) in a vacuum at a temperature of about 30020 C. to about 700° C. and wherein the time period is from about 1 hour to about 16 hours.

33. A method according to claim 32, wherein the second struck titanium-containing metal is non-oxidatively heat treated in step (c) at a temperature of about 500° C. for about 5 hours.

34. A method according to claim 14, further comprising the step of electroless plating a third metallic coating onto the surface of the non-oxidatively heat treated titanium-containing metal in a third electrolyte bath.

35. A method according to claim 34, wherein the step of electroless plating is performed by submersing the non-oxidatively heat treated titanium-containing metal into the third electrolyte bath under conditions and for period of time sufficient to deposit the third metallic coating to a desired thickness.

36. A method according to claim 35, wherein the period of time is about 10 minutes to about 60 minutes.

37. A method according to claim 36, wherein the period of time is about 30 minutes.

38. A method according to claim 34, wherein the third electrolyte bath comprises nickel phosphorous.

39. A method according to claim 34, wherein the third metallic coating comprises nickel.

40. A method according to claim 34, further comprising the step of heat treating the third struck titanium-containing metal at a temperature and for a period of time sufficient to promote adhesion between the third metallic coating and the second metallic coating.

41. A method according to claim 40, wherein the third struck titanium-containing metal is heated at a temperature of about 100° C. to about 500° C. and wherein the period of time is from about 1 hour to about 4 hours.

42. A method according to claim 41, wherein the third struck titanium-containing metal is heated at a temperature of 125° C. for about 2 hours.

43. A method for plating a titanium-containing metal, comprising the steps of:

(a) treating at least a portion of a surface of the titanium-containing metal with an anodic activation and subsequently strike plating at least a portion of the surface of the treated titanium-containing metal with a first metallic coating in a first electrolyte bath, wherein the titanium-containing metal remains submerged in the first electrolyte bath for the duration of step (a);

(b) strike plating the first struck titanium-containing metal with a second metallic coating in a second electrolyte bath;

(c) non-oxidatively heat treating the second struck titanium-containing metal for a period of time sufficient to cause diffusion bonding between the first metallic coating and the titanium-containing metal;

(d) electroless plating a third metallic coating onto the surface of the non-oxidatively heat treated titanium-containing metal in a third electrolyte bath; and (e) heat treating the third struck titanium-containing metal at a temperature and for a period of time sufficient to promote adhesion between the third metallic coating and the second metallic coating.

* * * * *